US007685773B2

(12) United States Patent
Morton

(10) Patent No.: US 7,685,773 B2
(45) Date of Patent: Mar. 30, 2010

(54) SLIDING WINDOW ASSEMBLY WITH WINDLOAD AND IMPACT RESISTANCE

(75) Inventor: Philip G. Morton, Germantown, OH (US)

(73) Assignee: Deceuninck North America, LLC, Monroe, OH (US)

( * ) Notice: Subject to any disclaimer, the term of this patent is extended or adjusted under 35 U.S.C. 154(b) by 368 days.

(21) Appl. No.: 11/800,593

(22) Filed: May 7, 2007

(65) Prior Publication Data

US 2008/0276542 A1 Nov. 13, 2008

(51) Int. Cl.
*E05D 15/16* (2006.01)

(52) U.S. Cl. ..... 49/410; 49/431; 49/458

(58) Field of Classification Search ..... 49/409, 49/410, 431, 524, 458, 24, 425; 16/DIG. 6
See application file for complete search history.

(56) References Cited

U.S. PATENT DOCUMENTS 3,947,998 A * 4/1976 Matsubara ..... 49/209
4,158,934 A * 6/1979 Olsen ..... 49/406
4,674,246 A * 6/1987 Giguere ..... 52/204.51
5,148,630 A * 9/1992 Llorens ..... 49/425
5,884,361 A * 3/1999 Richardson et al. ..... 16/100
D453,381 S 2/2002 Ballard et al.
D460,831 S 7/2002 Ballard et al.
D461,257 S 8/2002 Ballard et al.
6,718,695 B1 * 4/2004 Park ..... 49/425
6,826,871 B2 12/2004 Morton et al.
2008/0092452 A1 * 4/2008 Chubb et al. ..... 49/458

* cited by examiner

*Primary Examiner*—Jerry Redman
(74) *Attorney, Agent, or Firm*—Jacox, Meckstroth & Jenkins

(57) ABSTRACT

A sliding window assembly includes two rectangular sash frames each enclosing an insulated glass panel unit and supported by a surrounding main support frame. At least one of the sash frames is supported for horizontal movement, and horizontally extending interlocking members are formed on the adjacent upper and lower horizontal frame members of the sash frame and main support frame. The interlocking members have interfitting horizontal hook portions positioned to permit each movable sash frame to move freely between a closed position and an open position. The interfitting hook portions are effective to engage and interlock each other in response to a substantial positive or negative windload or such a windload after an impact which breaks the glass panel unit, to limit deflection and prevent permanent deformation or release of the sash frame.

16 Claims, 3 Drawing Sheets

SLIDING WINDOW ASSEMBLY WITH WINDLOAD AND IMPACT RESISTANCE

BACKGROUND OF THE INVENTION

In the art of window assemblies having outer main window frames surrounding sash frames and formed of extrusions of a plastics material or polyvinylchloride, commonly referred to as vinyl or PVC, it has been found desirable in some installations, especially in residential and commercial buildings near the ocean and Gulf coast, to provide for keeping the window assembly in tact during a high windload, for example, during a hurricane or tornado. For example, U.S. Pat. No. 6,826,871, which issued to the assignee of the present invention, discloses a double hung or single hung window unit constructed of vinyl extrusions and incorporating hook members on the sill and bottom sash member. The hook members engage in response to a high negative windload to limit deflection of the sash frame and thereby avoid permanent deformation and/or separation of the sash frame from the main frame. It is also desirable to limit deflection of a movable sash frame or separation of the sash frame from the surrounding main frame after the window glazing and glass panel unit are subjected to a high negative or positive windload after an impact by an object sufficient to break the glass panel unit, such as during a hurricane or tornado.

SUMMARY OF THE INVENTION

The present invention is directed to an improved sliding window assembly which may be in the form of a sliding glass door assembly and including a main support frame surrounding a set of sash frames, with all frames formed of extrusions of rigid material such as PVC. Each sash frame surrounds and supports a glass panel unit, and at least one sash frame is supported for sliding movement within the main support frame between open and closed positions. As used herein the term "sliding" also includes rolling as commonly used on sash frames of sliding glass windows and doors. The main frame includes upper and lower horizontal main frame members rigidly connected by vertical main frame members, and each sash frame includes upper and lower horizontal sash frame members rigidly connected by vertical sash frame members. Parallel spaced frame members of the sash frame and adjacent main support frame members are provided with interlocking members having interfitting portions which permit each movable sash frame to move freely between a closed position and an open position. The interfitting hook portions are effective to engage and interlock each other in response to a substantial positive or negative windload or after an impact against the glass panel unit and sash frame to limit deflection and prevent permanent deformation or release of the sash frame from the main support frame.

Other features and advantages of the invention will be apparent from the following description, the accompanying drawings and the appended claims.

DESCRIPTION OF ILLUSTRATED EMBODIMENT

Figure 1:
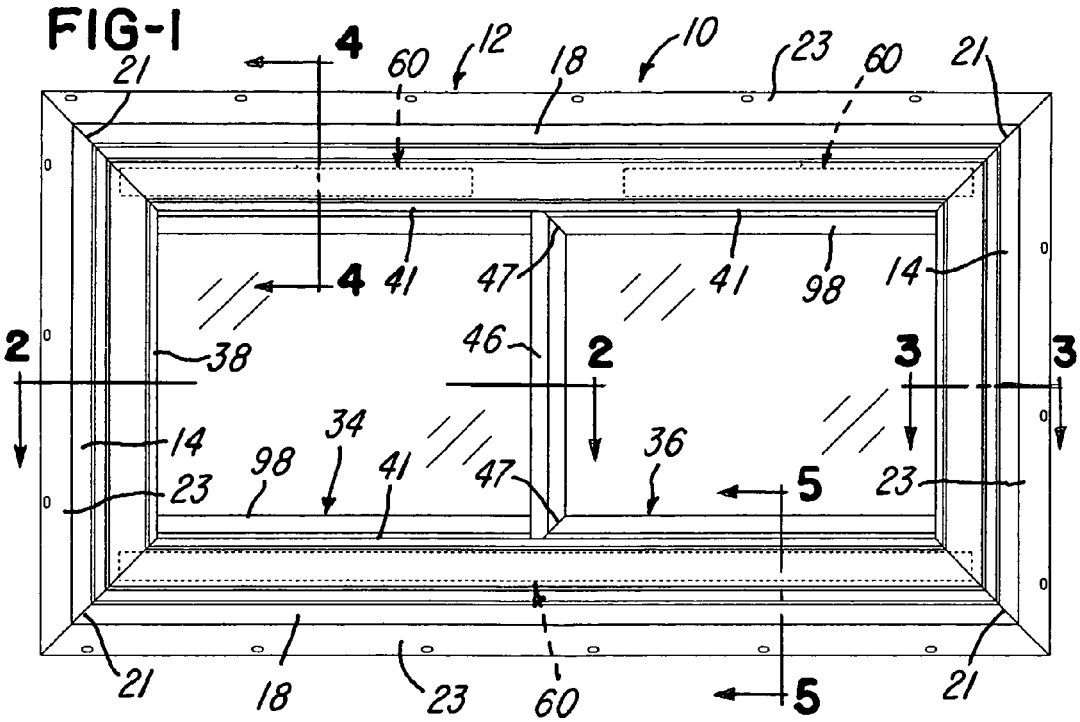
FIG. 1 is an elevational view of a closed horizontal sliding window assembly constructed in accordance with the invention.

FIG. 1 illustrates a sliding window assembly 10 which includes a rectangular outer or main support frame 12 constructed of horizontally spaced vertical main frame members 14 and upper and lower horizontal main frame members 18. The cross hatching for a plastics material and for metal and glass in FIGS. 2-7 has been omitted for purpose of clarity. Each of the frame members is formed from an extrusion of rigid plastics material or vinyl and has a common and uniform cross-sectional configuration or profile as shown in FIGS. 2-5. The profile is substantially the same as the profile disclosed in U.S. Design Pat. No. D453,381 which issued to the assignee of the present invention. Preferably, the outer main frame members 14 and 18 have welded mitered corner joints 21 and laterally outwardly projecting nailing flanges 23 used to secure the outer support frame 12 within a rough opening 24 (FIG. 3) of a building structure 25 with peripherally spaced nails 27. Screws 28 may also be used to secure the frame 12 to building structural members 29 defining the opening 24.

Figure 5:
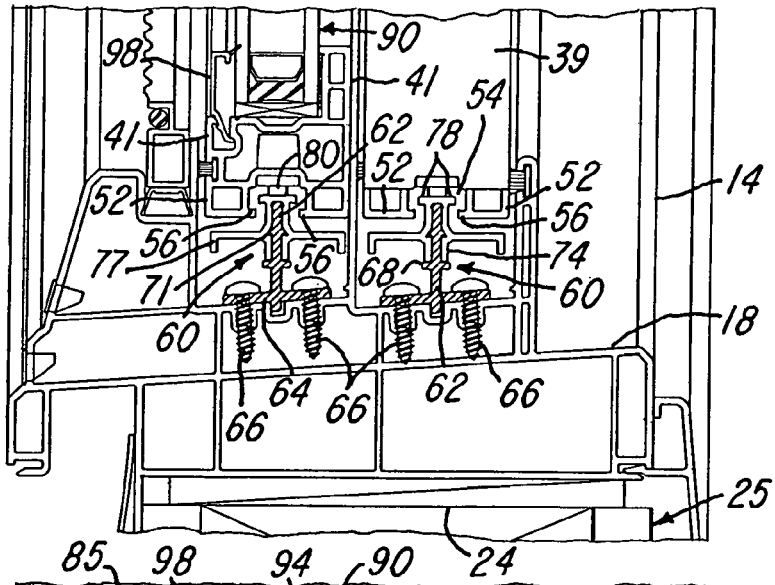

The outer main frame 12 supports a set of rectangular sash frames 34 and 36, and the sash frame 34 includes a set of vertical sash frame members 38 and 39 (FIG. 2) rigidly connected to a horizontal upper sash frame member 41 (FIG. 4) and a lower sash frame member 41 (FIG. 5). The sash frame 36 also includes vertical sash frame members 38 (FIG. 3) and 46 (FIG. 2) which are rigidly connected by an upper horizontal sash frame member 41 (FIG. 4) and a lower horizontal sash frame member 41 (FIG. 5). All of the sash frame members are formed from extrusions of rigid plastics material or vinyl and have primarily the same profile so that the vertical and horizontal sash frame members may be rigidly connected by welded mitered corner joints 47 (FIG. 1). The vertical sash frame members 38 have a profile substantially the same as the profile of the window component extrusion disclosed in U.S. Design Pat. No. D460,831, and the vertical sash frame member 39 has a profile substantially the same as the profile of the window component extrusion disclosed in U.S. Design Pat. No. D461,257.

In accordance with the present invention, the lower sash frame members 41 (FIG. 5) and the upper sash frame members 41 (FIG. 4) also include a pair of parallel spaced hook portions or members 52 (FIGS. 4 & 5) which are extruded as integral parts of the sash frame members. The hook portions 52 define therebetween a horizontally extending slot or groove 54 and have horizontally extending opposing lips 56 projecting into the groove 54. Each of the lips 56 may have an inner surface with a slight taper or undercut.

The lower horizontal main frame member 18 (FIG. 5) and the upper horizontal main frame member 18 (FIG. 4) support horizontally extending rigid interlocking members 60. Each of the interlocking members 60 has a base portion extruded from a metal such as aluminum and includes a horizontally extending vertical rib 62 projecting from a slightly inclined base flange 64. The flange 64 is secured to an inner wall of the main frame member 18 by a series of longitudinally spaced sets of self-tapping screws 66. The rib 62 has horizontally extending and outwardly projecting minor ribs 68 and horizontally extending tapered barbs 71 projecting laterally from opposite sides of the rib 62.

A horizontally extending cap or hook member 74 is extruded of a rigid plastics material or vinyl and seats on the rib 62 where it is secured and locked by the tapered barbs 71. The cap or hook member 74 has horizontally extending and laterally outwardly projecting flanges 77 which cover the head of the screws 66. The hook member 74 also has horizontally extending and laterally outwardly projecting lips 78 which may also have tapered or undercut inner surfaces. The rib 62 and hook member 74 of each interlocking member 60 project vertically into the groove 54 of the corresponding adjacent horizontal sash frame member so that the lips 78 are located inwardly within the groove 54 from the lips 56.

Referring to FIG. 1, the lower interlocking member 60 for each sash frame extends horizontally generally the full width of the lower horizontal main frame member 18, and the upper horizontal interlocking member 60 for each sash frame extends slightly less than one half the width of the corresponding sash frame member 41. As shown in FIG. 5, the lower horizontal sash frame member 43 for each sash frame 36 and 38 carries a set of horizontally spaced roller units 80 which have wheels that roll upon the top surface of the cap or hook member 74 which provides a track for free horizontal movement of each of the sash frames 34 and 36. As shown in FIGS. 2-5, the outer main frame members 14 and 18 define a channel 83 which receives a rectangular frame 84 of a conventional screen unit 85. The screen unit 85 includes a flexible screen material 86 having a peripheral edge portion secured to the frame 84 which is supported within the channel 83 by a set of leaf springs 87 (FIG. 5) which permit the screen unit to be easily removed by shifting the screen unit downwardly and laterally against the springs by a slight amount within the groove 83 to release an upper and side portions of the frame 84 from the channel 83.

In a conventional manner, each of the sash frames 34 and 36 supports an insulated glass panel unit 90 constructed in a conventional manner with parallel spaced rectangular glass panes or panels 92 separated by a peripherally extending spacer member 94 and bonded together by a bonding material 96 such as butyl rubber. The glass panel unit 90 is retained within the corresponding sash frame by peripherally extending and removable linear glazing beads or members 98 also extruded of a plastics material. While the insulated glass panel unit 90 is illustrated with two glass panes or panels 92 for simplification, it is to be understood that the unit 90 may be constructed in other forms, for example, with three glass panels having two inner glass panels separated by a transparent inner layer of PVB. This construction or assembly is commonly used to prevent the glass panels from shattering into pieces and separating when subjected to a high wind force or impact causing the glass panels to crack.

Figure 2:
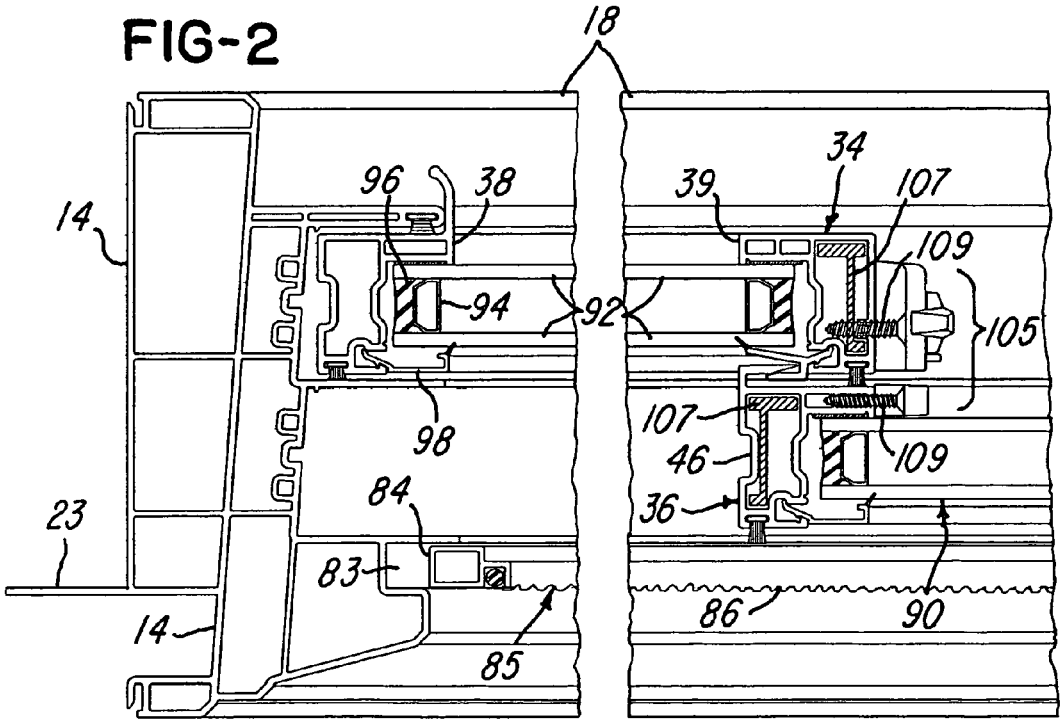
FIG. 2 is a fragmentary section of the window assembly in its closed position, taken generally on the line 2-2 of FIG. 1.
Figure 3:
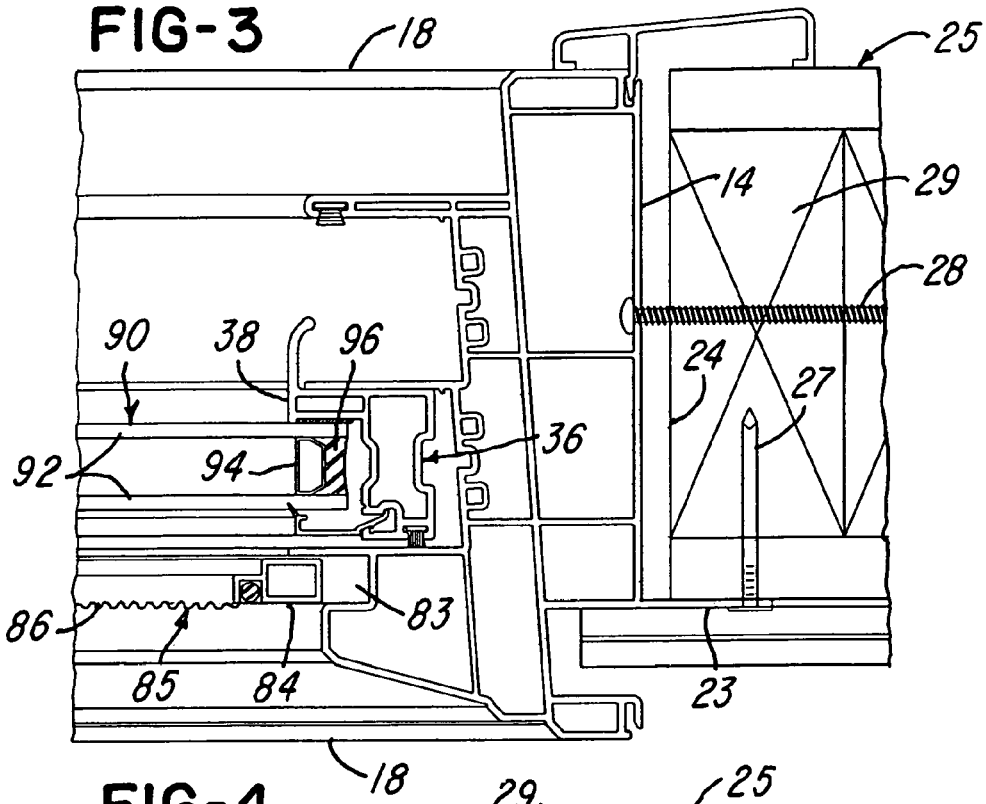
FIGS. 3-5 are fragmentary sections similar to FIG. 2 and taken generally on the lines 3-3, 4-4 and 5-5 of FIG. 1.
Figure 4:
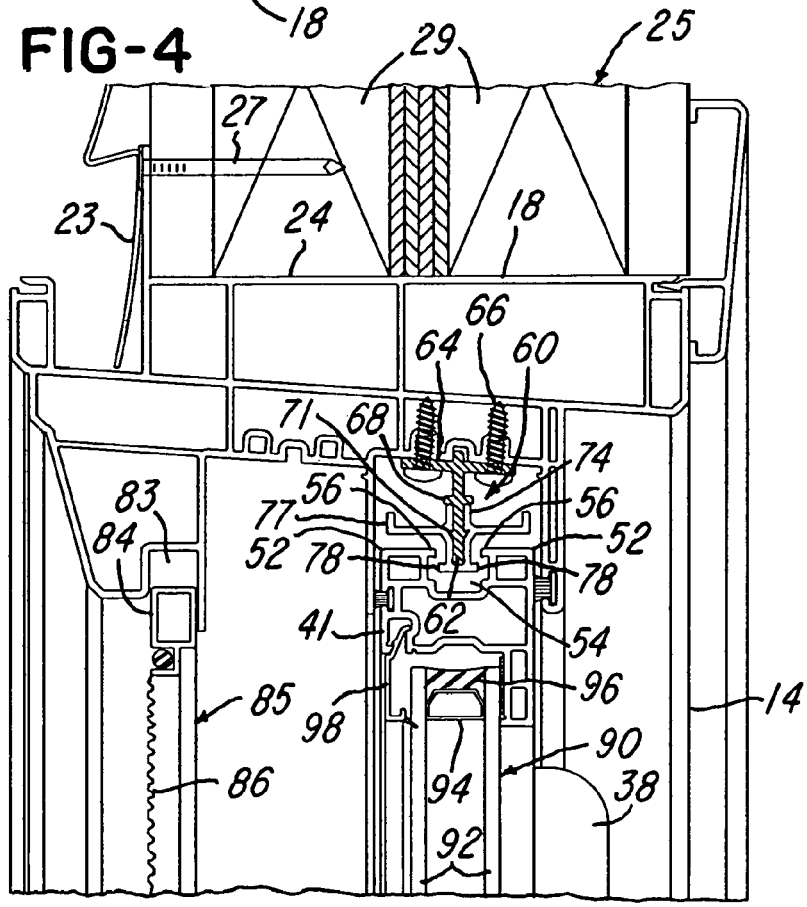

Referring to FIG. 2, the vertical sash frame members 39 and 46 of the sash frames 34 and 36, respectively, support a conventional latch unit 105, and each of the sash frame members 39 and 46 are provided with a vertically extending metal reinforcing member 107 which is preferably formed from an aluminum extrusion. The latch unit 105 is secured to the sash frame members 39 and 46 by a set of screws 109 which extend into the reinforcing member 107 within the sash frame member 39.

Figure 6:
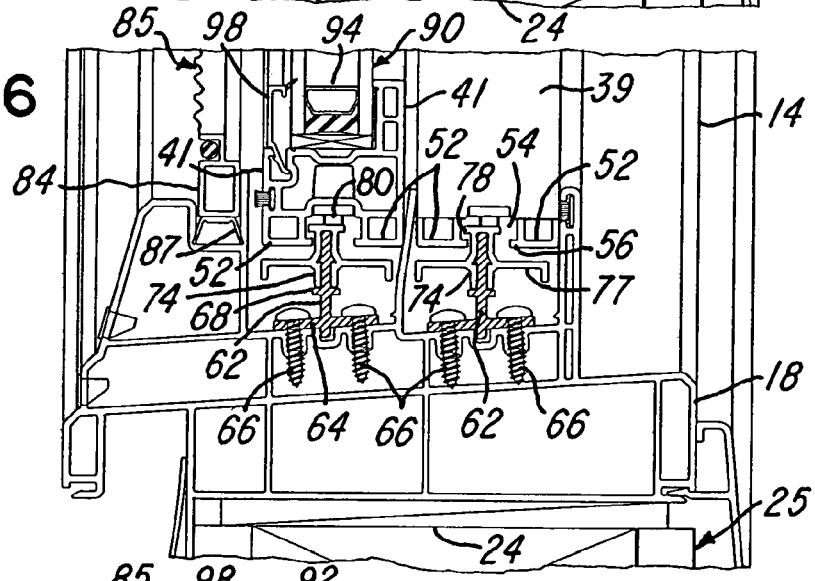
FIG. 6 is a fragmentary section similar to FIG. 5 and showing the deflection of the sash frames and the interlocking of the lower frame members in response to a high positive pressure on the outside surfaces of the sash frames and window panels.

FIG. 6 illustrates the interlocking of the interfitting hook members 52 and 74 which occurs between the upper and lower sash frame members and the corresponding upper and lower main frame members in response to a high positive pressure on the outer surfaces of the glass units 90 and the corresponding sash frames 34 and 36 due to a high windload or impact such as occurs during a hurricane. As shown, the lips 56 on the sash frame members shift and hook under the lips 78 of the hook members 74 of the interlocking members 60 secured to the upper and lower horizontal main frame members. In this condition, each of the glass units 90 may have broken, but the interlocking and hooking of the hook members 52 and 74 are effective to lock the upper and lower sash frame members to the corresponding upper and lower main frame members and thereby prevent the sash frame and window unit from being separated from the outer main frame. As mentioned above, in order to prevent the glass unit from shattering and pieces of glass flying loosely, the glass unit may incorporate an inner sandwiched layer of PVB film material which is well known in the assembly of insulated glass units.

Figure 7:
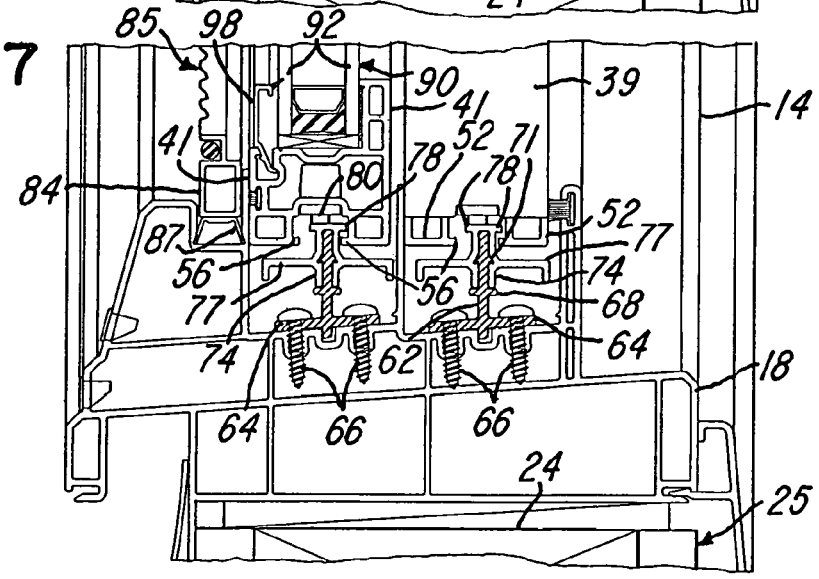
FIG. 7 is a fragmentary section similar to FIG. 6 and showing the deflection of the sash frames and the interlocking of the lower frames in response to a high negative pressure on the outer surfaces of the window panels and sash frames.

FIG. 7 is similar to FIG. 6, but illustrates the interlocking of the interfitting hook members 52 and 74 in response to substantial negative pressure due to a suction on each of the glass panel units 90 and the corresponding sash frame 34 and 36 when the window assembly is in its closed position. As shown, under such negative pressure, the inner lips 56 of the upper and lower sash frame members shift under the inner lips 78 on the upper and lower main frame members and interlock in a hooking manner to assure that each of the sash frames and corresponding glass units remain substantially intact and rigidly connected to the outer main frame during the wind force.

From the drawings and the above description, it is apparent that a sliding window or door assembly incorporating interfitting and interlocking hook members in accordance with the invention, provide desirable advantages. For example, the hook members provide for interlocking of each sash frame to the main support frame during high negative or high positive windload or after an impact from a flying object and thereby limit deflection of each sash frame and prevent permanent deformation of the sash frame. In addition, the hook members remain engaged or interconnected until the high wind forces are removed when each of the sash frames returns to its normal position, as shown in FIGS. 2-5. In the event that the insulated glass unit breaks during a high hurricane windload or due to an impact, the glass unit remains with the sash frame and the sash frame remains interlocked with the outer main frame. However, when it is desired to remove either of the horizontal sliding sash frames and its corresponding window unit from the outer main frame, the sash frame is moved or shifted horizontally to its open position where the upper sash frame member is free of the corresponding interlocking member 60, and the sash frame and glass unit may be tilted inwardly and lifted from the lower interlocking member 60.

While the form of sliding window assembly herein described constitute one embodiment of the invention, it is to be understood that the invention is not limited to this precise form of assembly and that changes may be made therein without departing from the scope and spirit of the invention as defined in the appended claims. As mentioned above, the invention may also be used with a sliding door assembly by providing the upper and lower horizontal sash frame members with hook members 52 and by mounting interlocking members 60 on the corresponding upper and lower main frame members of the door assembly.

What is claimed is:

1. A sliding window assembly comprising a main support frame including upper and lower elongated horizontal main frame members and elongated vertical main frame members of rigid material and adapted to be installed within an opening of a building structure, at least one sash frame including upper and lower elongated horizontal sash frame members and elongated vertical sash frame members of rigid material and supported for sliding movement within said main support frame between an open position and a closed position, a glass window panel mounted within said sash frame, parallel spaced sash frame members and the corresponding adjacent parallel spaced said main frame members including interlocking members having hook portions, said hook portions of said interlocking members engage in response to deflection of said sash frame by a substantial windload against said window panel and said sash frame in said closed position to limit deflection of said sash frame, each of said interlocking members on said parallel spaced main frame members comprising a longitudinally extending metal reinforcing member having a base flange rigidly secured to a corresponding one of said main frame members, and a longitudinally extending cap member of plastics material mounted on each said metal reinforcing member and having at least one longitudinally extending and laterally projecting lip forming a corresponding one of said hook portions.

2. A window assembly as defined in claim 1 wherein said hook portions of said interlocking members engage in response to a below atmosphere negative air pressure on outer surfaces of said glass window panel and said sash frame.

3. A window assembly as defined in claim 1 wherein said hook portions of said interlocking members engage in response to an above atmospheric positive air pressure on outer surfaces of said glass window panel and said sash frame.

4. A window assembly as defined in claim 1 wherein said hook portions of said interlocking members engage in response to either a below atmospheric negative air pressure or an above atmospheric positive air pressure on outer surfaces of said glass window panel and said sash frame.

5. A window assembly as defined in claim 1 wherein said hook portions of said parallel spaced sash frame members each defines a groove and includes a set of opposing lips projecting into said groove to form said interlocking members.

6. A window assembly as defined in claim 5 wherein said interlocking members comprise integral parts of said sash frame members.

7. A window assembly as defined in claim 5 wherein each of said parallel spaced main frame members of said main support frame includes a longitudinally extending elongated rib projecting into said groove of the adjacent one of said sash frame members, and each of said ribs has longitudinally extending lips projecting laterally in opposite directions and interfitting with said lips of the adjacent one of said sash frame members.

8. A window assembly as defined in claim 1 wherein one of said interlocking members is located on said lower of said horizontal main frame members and extends generally a full width of said window assembly between said vertical main frame members.

9. A window assembly as defined in claim 8 wherein one of said interlocking members is located on said upper of said horizontal main frame members and extends generally one half of a full width of said window assembly between said vertical main frame members.

10. A sliding window assembly comprising a main support frame including vertically spaced upper and lower elongated horizontal main frame members of rigid plastics material, said horizontal main frame members rigidly connecting horizontally spaced elongated vertical main frame members of rigid plastics material, said main support frame adapted to be installed within an opening of a building structure, at least one sash frame including vertically spaced upper and lower elongated horizontal sash frame members of rigid plastics material, said horizontal sash frame members rigidly connecting horizontally spaced elongated vertical sash frame members of rigid plastics material, said sash frame supported for horizontal movement within said main support frame between an open position and a closed position, a glass window panel mounted within said sash frame, said upper and lower horizontal sash frame members and the corresponding adjacent said upper and lower horizontal main frame members including horizontal interlocking hook portions, said interlocking hook portions of said upper and lower horizontal sash frame members extending horizontally from one of said vertical sash frame members to the other of said vertical sash frame members, and said interlocking hook portions on said upper and lower sash frame members engage said hook portions on said upper and lower main frame members along a full width of said sash frame in response to deflection of said sash frame by a substantial wind load against said window panel and said sash frame in said closed position to limit deflection of said sash frame.

11. A window assembly as defined in claim 10 wherein said interlocking hook portions engage in response to either a below atmospheric negative air pressure or an above atmospheric positive air pressure on outer surfaces of said glass window panel and said sash frame.

12. A window assembly as defined in claim 10 wherein said interlocking hook portions of said horizontal sash frame members each defines a groove and includes a set of opposing lips projecting into said groove.

13. A window assembly as defined in claim 12 wherein said interlocking hook portions comprise integral parts of said horizontal sash frame members.

14. A window assembly as defined in claim 12 wherein each of said upper and lower main frame members of said main support frame includes a longitudinally extending elongated rib projecting into said groove of the adjacent one of said sash frame members, and each of said ribs has longitudinally extending lips projecting laterally in opposite directions and interfitting with said lips of the adjacent one of said sash frame members.

15. A window assembly as defined in claim 10 wherein said interlocking hook portions on said upper and lower horizontal main frame members each comprises a horizontally extending metal reinforcing member having a base flange rigidly secured to an adjacent one of said main frame members, a horizontally extending cap member of plastics material mounted on said metal reinforcing member and having horizontally extending lips projecting laterally in opposite directions, and said cap member has horizontally extending flanges projecting laterally in opposite direction in spaced relation from said base flange.

16. A window assembly as defined in claim 10 wherein one of said interlocking hook portions is located on said upper of said horizontal main frame members and extends generally only one half of a full width of said window assembly between said vertical main frame members.

* * * * *